US009702519B2

(12) United States Patent
Reiners

(10) Patent No.: US 9,702,519 B2
(45) Date of Patent: Jul. 11, 2017

(54) HEADLIGHT MODULE

(71) Applicant: OSRAM GMBH, Munich (DE)

(72) Inventor: Thomas Reiners, Bachhagel (DE)

(73) Assignee: OSRAM GmbH, Munich (DE)

( * ) Notice: Subject to any disclaimer, the term of this patent is extended or adjusted under 35 U.S.C. 154(b) by 395 days.

(21) Appl. No.: 14/594,937

(22) Filed: Jan. 12, 2015

(65) Prior Publication Data

US 2015/0124468 A1 May 7, 2015

Related U.S. Application Data

(63) Continuation of application No. 13/697,782, filed as application No. PCT/EP2011/057314 on May 6, 2011, now abandoned.

(30) Foreign Application Priority Data

May 12, 2010 (DE) ..... 10 2010 028 949

(51) Int. Cl.
*F21S 8/10* (2006.01)

(52) U.S. Cl.
CPC ..... *F21S 48/1225* (2013.01); *F21S 48/1136* (2013.01); *F21S 48/1159* (2013.01); *F21S 48/1258* (2013.01); *F21S 48/1747* (2013.01); *F21S 48/1757* (2013.01); *F21S 48/325* (2013.01)

(58) Field of Classification Search
CPC ..... F21S 48/1225; F21S 48/1136; F21S 48/1159; F21S 48/1258; F21S 48/1747; F21S 48/1757; F21S 48/325
USPC ..... 362/510, 84, 507, 509, 514, 516, 517, 362/538
See application file for complete search history.

(56) References Cited

U.S. PATENT DOCUMENTS

| | | | |
|---|---|---|---|
| 6,497,503 | B1 | 12/2002 | Dassanayake et al. |
| 6,690,114 | B2 | 2/2004 | Nakayama et al. |
| 6,993,255 | B2 | 1/2006 | Braun et al. |
| 6,994,458 | B2 | 2/2006 | Holz et al. |
| 2009/0015388 | A1 | 1/2009 | Yagi et al. |

(Continued)

FOREIGN PATENT DOCUMENTS

| | | |
|---|---|---|
| DE | 101 61 177 | 6/2003 |
| DE | 10 2004 040 990 | 3/2005 |

(Continued)

OTHER PUBLICATIONS

Office Action dated Nov. 8, 2017 which issued in the corresponding Chinese Patent Application No. 201510284870.0.

(Continued)

*Primary Examiner* — Laura Tso
(74) *Attorney, Agent, or Firm* — Cozen O'Connor

(57) ABSTRACT

A headlight module comprising separate phosphors which can be excited by electromagnetic radiation to emit light, and at least one radiation source for exciting the phosphors. Each phosphor is associated with an optical device, so that light emitted by the optical devices is merged into an overall image. Beam splitter devices and beam directing devices are disposed such that electromagnetic radiation emitted by the at least one radiation source is directed on the phosphors. A control device is provided for controlling operation of the at least one radiation source and the beam directing devices.

9 Claims, 4 Drawing Sheets

(56) References Cited

U.S. PATENT DOCUMENTS

| | | | | |
|---|---|---|---|---|
| 2009/0046474 | A1 | 2/2009 | Sato et al. | |
| 2010/0149816 | A1 | 6/2010 | Higashi et al. | |
| 2010/0208478 | A1 | 8/2010 | Fang et al. | |
| 2011/0141754 | A1 | 6/2011 | Hikmet et al. | |
| 2011/0157865 | A1 | 6/2011 | Takahashi et al. | |
| 2011/0222265 | A1 | 9/2011 | Drenten et al. | |
| 2012/0026721 | A1 | 2/2012 | Kurt et al. | |
| 2014/0362600 | A1* | 12/2014 | Suckling | F21S 48/1145 362/583 |

FOREIGN PATENT DOCUMENTS

| | | |
|---|---|---|
| DE | 10 2007 037 875 | 2/2009 |
| DE | 10 2008 022 795 | 11/2009 |
| DE | 10 2008 031 996 | 2/2010 |
| EP | 0 460 913 | 12/1991 |
| EP | 1 270 324 | 1/2003 |
| EP | 2 063 170 | 5/2009 |
| JP | 04-031202 U | 3/1992 |
| JP | 05-221260 | 8/1993 |
| JP | 2000-326786 | 11/2000 |
| JP | 2005-150041 | 6/2005 |
| JP | 2007-242414 | 9/2007 |
| JP | 2007-323858 | 12/2007 |
| JP | 2009-048786 | 3/2009 |
| JP | 2009-129683 | 6/2009 |
| JP | 2009-266437 | 11/2009 |
| JP | 2010-036835 | 2/2010 |
| JP | 2011-142000 | 7/2011 |
| JP | 2011-222238 | 11/2011 |
| WO | WO 2009/147582 | 12/2009 |
| WO | WO 2010/020930 | 2/2010 |

OTHER PUBLICATIONS

Office Action dated Jan. 10, 2017 which issued in the corresponding Japanese Patent Application No. 2014-245839.

* cited by examiner

HEADLIGHT MODULE

RELATED APPLICATIONS

This application is a continuation of U.S. application Ser. No. 13/697,782 filed Nov. 13, 2012 (now abandoned) which claims the priority under 35 U.S.C. 371 of International application No. PCT/EP2011/057314 filed on May 6, 2011. Priority is also claimed of German application no. 10 2010 028 949.3 filed on May 12, 2010. The entire contents of the International application and the German priority application are hereby incorporated by reference.

FIELD OF THE INVENTION

The present invention relates to a headlight module comprising separate phosphors which can be excited by electromagnetic radiation to emit light, and at least one radiation source for exciting the phosphors; each phosphor being assigned an optical device, so that light emitted by the optical devices is merged into an overall image.

BACKGROUND OF THE INVENTION

Such a headlight module is disclosed, for example, in WO 2010/000610 A1. This publication describes a lighting unit for vehicle headlights, said lighting unit having, as a light source, LED chips which are provided with a coating of phosphor (chip layer coating) in order to convert the blue light produced by the LED chips into white light. Said lighting unit is embodied as an integral part of a vehicle headlight and can therefore be regarded as a headlight module. In this patent application the term headlight module denotes a module which is designed for use in a headlight or is implemented as a component part of a headlight. Within the meaning of the invention, this module can be implemented as a constructional unit that is used as a single entity in a headlight, or as a system of individual, interacting components of a headlight.

The headlight module according to the invention is likewise designed primarily for use in a vehicle headlight, even though other fields of application are also possible.

In addition to the legally required low beam and high beam, high-end vehicle headlights currently also produce variable light distributions such as dynamic and static cornering light based on the provisions of ECE Regulation 123. In the near future, adaptive high beam will also be permitted. Here parts of the high-beam light are masked out in order to avoid dazzling the traffic ahead or the oncoming traffic. In addition, all current headlight systems must be designed to swivel about a horizontal axis at right angles to the direction of travel in order to provide the range adjustment of the headlight. In very high-performance headlights this adjustment must even be performed automatically as a function of the loading condition of the vehicle. Particularly in the case of the LED headlights used more recently, this means that the entire system including a heavy cooling system has to be swiveled.

For this purpose mechanical systems with stepper motors are normally used to swivel the headlight module about a horizontal axis. To implement a dynamic cornering light it is also known to swivel the headlight module about a vertical axis.

For adaptive high beam and other variable light distributions, mechanical systems with hinged shutters or rollers, by means of which the light from discharge lamps or even halogen lamps is selectively masked out, continue to be used.

Also known are so-called matrix headlights based on discharge lamps which contain an imaging element and wherein each pixel is responsible for a particular solid angle element. These headlights are referred to as pixel or matrix AFS (adaptive front lighting system) headlights. They require on the one hand a high luminance in order to keep the optical components small, and also a high luminous flux which is then—depending on the desired light distribution—largely masked out again, so that only a small part of the high luminous flux is actually used.

The advantages of an intensity modulated matrix headlight of this kind are its high resolution and therefore the possibility of dispensing with servomotors and moving components, while its disadvantage lies, on the one hand, in the high implementation costs and, on the other, in the low efficiency because of the light loss inherent in the design.

Multi-LED headlights apply light only where it is required, and can therefore in principle be more efficient. However, because of the limited number of LEDs that can be switched at acceptable cost, they do not provide enough resolution to adjust the headlight beam sufficiently finely. They therefore still require servomotors and moving parts.

To summarize, all of the currently known systems represent a compromise in terms of efficiency, cost and use of mechanical systems and therefore necessarily reliability.

SUMMARY OF THE INVENTION

One object of the present invention is to provide a headlight module that will provide dynamic light distribution for different driving situations as inexpensively as possible, with a high degree of reliability and maximum efficiency, without involving the need to swivel the headlight module.

This and other objects are attained in accordance with one aspect of the invention directed to a headlight module comprising separate phosphors which can be excited by electromagnetic radiation to emit light, and at least one radiation source for exciting the phosphors. Each phosphor is assigned an optical device, so that light emitted by said optical devices is merged into an overall image. Beam splitter devices and beam directing devices are disposed such that electromagnetic radiation emitted by the at least one radiation source is directed on the phosphors. A control device is provided for controlling operation of the at least one radiation source and the beam directing devices.

The headlight module according to one embodiment of the invention has at least one luminescent material (phosphor) or one phosphor mix which can be excited by electromagnetic radiation to emit light, and at least one radiation source for exciting the at least one phosphor or phosphor mix. The headlight module additionally has at least one beam directing device, wherein the at least one beam directing device is disposed or implemented such that it directs electromagnetic radiation emitted by the at least one radiation source onto the at least one phosphor or phosphor mix. The at least one beam directing device makes it possible for the phosphor or phosphor mix to be excited only at the positions which correspond to a dynamic light distribution currently to be set in the driver's field of vision, e.g. on the roadway. Similarly to the scanning method of a scanner, the electromagnetic radiation emitted by the radiation source is guided by means of the beam directing device over the entire luminescent surface of the carrier device or only over a part thereof. Therefore, only the regions of the phosphor or phosphor mix over which the electromagnetic radiation has been guided are excited to emit light. Said beam is guided faster then the human eye can follow. In this way there is produced on the luminescent surface of the carrier device a light distribution which, by means of projection optics, can be projected, for example, onto the roadway to be illuminated.

The at least one radiation source is preferably a laser, e.g. a laser diode or an array of laser diodes or one or more light-emitting diodes, in particular superluminance diodes. By means of these radiation sources, electromagnetic radiation from the spectral range of visible light and in the ultraviolet and infrared region can be produced extremely efficiently and used to excite the phosphor or phosphor mix. Preferably an ultraviolet radiation or blue light emitting LED arrangement and with particular preference a laser diode arrangement is used as the radiation source, with white light being generated therefrom by means of the phosphor or phosphor mix in order to provide, for example, a white light emitting vehicle headlight.

On the basis of the embodiments of the present invention a large number of advantages can be achieved:

Due to the fact that the radiation can be modulated in the excitation radiation source, using the scanning process referred to above the phosphor is only excited where it is required, resulting in a high degree of efficiency. Efficiency impairment, as known from the prior art, due to downstream modulation and masking-out of radiation is unnecessary. This helps to reduce vehicle gasoline consumption and $CO_2$ emissions.

A high resolution can be achieved by the present invention. The beam directing device which can be implemented, for example, as a micromirror device (MEMS, MOEMS, DMD) enables a resolution in the 1000×1000 pixel range to be produced, thereby realizing the legally required adjustment of the light distribution without stepper motors. In addition, cornering light, adaptive high beam and other variable light distributions as defined in ECE Regulation 123 can be generated by dynamically varying the light distribution without mechanically moving the headlight module as a whole. Because of their low weight, the micromirrors can be moved without difficulty.

Any aspect ratio can be set by means of the present invention. The phosphor area swept by the beam directing device and the phosphor itself can be produced inexpensively in any length/width ratio (in one piece or cut into pieces), thereby enabling the particular characteristics of a headlight beam distribution to be taken into account.

Another advantage of the present invention is its high flexibility. The desired light distribution can be programmed in any form by software. This enables not only high-functionality headlights but also simple light distributions to be produced using the same headlight module. If a laser is employed as the excitation radiation source, by using a smaller laser class, i.e. with lower power consumption, a light source for a frugal electric car can be produced, while very complex/costly and design-driven headlights are possible using higher laser outputs or a plurality of outlet surfaces, implemented by lenses and reflectors.

In a preferred embodiment, the headlight module additionally comprises at least one at least partially transparent optical device which is disposed in the beam path of the radiation emitted by the at least one phosphor or phosphor mix. This can preferably be an aspherical lens and/or freeform lens, thereby enabling a magnification or projection of the intermediate image on the phosphor to infinity to be implemented—for automobile headlights this is typically the case from a distance of 25 m onwards. By means of freeform lenses, a wanted distortion can be achieved, e.g. in order to produce an extension of the light distribution into peripheral regions. This enables the phosphor surface area to be kept small while still achieving an expansion of the light distribution onto larger areas.

In a preferred embodiment, the at least one carrier device is transparent and mounted on an optical filter device which is designed to at least partially reflect radiation emitted by the at least one phosphor. Here the at least one beam directing device is preferably disposed such that radiation emitted by the at least one excitation radiation source passes through the optical filter device and the carrier device before it is incident on the phosphor. By means of this embodiment, radiation emitted by the excitation radiation source is incident on the phosphor at a small angle, resulting in only very small distortions. The distortion correction measures therefore tend to be very minor. The space between the phosphor and the at least partially transparent optical device possibly present can be kept free of other elements.

In an alternative implementation, at least one carrier device is designed to reflect radiation emitted by the at least one phosphor and/or radiation emitted by the at least one excitation radiation source. Here the at least one beam directing device is preferably disposed such that radiation emitted by the at least one excitation radiation source is incident on the side of the phosphor facing away from the carrier device of the phosphor. Such a variant results in a particularly low overall depth. Moreover, it can be implemented extremely inexpensively, as no transparent carrier device and no optical filter device need to be provided.

The at least one carrier device is preferably thermally connected to cooling device, said cooling device constituting a heat sink. Alternatively, the heat sink can constitute the at least one carrier device. If the heat sink is made reflecting, e.g. by coating it with aluminum, aluminum oxide or titanium oxide, the phosphor can be applied directly to the heat sink in a particularly inexpensive manner.

The carrier device surface provided with the at least one phosphor or phosphor mix can be made planar or curved at least zonally. This enables a sharper definition to be achieved, as by means of a possibly to be provided curvature of the surface of the at least one phosphor it can be achieved that virtually all of the regions of the phosphor are at the focal point of the possibly to be provided at least partially transparent optical device. This can be achieved by a corresponding design of the surface of the phosphor or by the design of the carrier device.

The headlight module preferably comprises at least one beam splitter device which is disposed between the at least one excitation radiation source and the at least one beam directing device. This makes it possible to illuminate in an optimized manner a plurality of phosphor regions, which can be disposed separately from one another, by a beam directing device in each case. A separate optical device can be provided for each of said phosphor regions, so that the light leaving the headlight module is made up of the light of a plurality of overlapping individual light distributions.

In another embodiment, a plurality of phosphor regions with different phosphors are present, said phosphors being selected such that they produce different secondary colors. The latter are preferably selected such that they produce white when they subsequently overlap. Such a combination of phosphors can preferably be based on red-green-blue (RGB) color coordinates; however, other color systems of relevant familiarity to the average person skilled in the art are also possible.

The at least one beam directing device can comprise a micromirror device. The micromirror device preferably comprises at least one micromirror swivelable about two axes.

The headlight module preferably additionally comprises a control device for the at least one excitation radiation source and/or for the at least one beam directing device.

The control device is preferably designed to control at least one micromirror of the micromirror arrangement such that it assumes predefinable spatial positions and orientations, the control device also being designed to switch the radiation source on or off depending on the position or orientation of the at least one micromirror. In particular, the control device can be designed such that the electromagnetic radiation emitted by the radiation source is guided by means of the at least one micromirror row-wise or column-wise over the carrier device surface provided with phosphor.

Said electromagnetic radiation emitted by the radiation source can be guided by means of the at least one micromirror over the entire carrier device surface provided with phosphor and the radiation source can be turned on or off when particular positions or settings of the micromirror are attained, in order to excite only one section of the region provided with phosphor and thus produce a desired light distribution.

Alternatively, the electromagnetic radiation emitted by the radiation source can also be guided by means of the at least one micromirror over only part of the carrier device surface provided with phosphor, the radiation source in this case remaining continuously activated, likewise in order to excite only one section of the region provided with phosphor and produce a desired light distribution.

In the first case, the ability to modulate the excitation radiation source is utilized, thereby enabling a high degree of efficiency to be achieved, as light does not need to be unnecessarily suppressed or masked out. In the second case, radiation from the excitation radiation source is available longer for the solid angle at which light emission is required. As a result, the excitation radiation source can be scaled down, which is likewise reflected in increased efficiency and reduced implementation costs. Moreover, a more homogeneous use of the excitation radiation source is achieved thereby.

The optical device can comprise at least one reflection device which is disposed such that at least radiation emitted by the at least one phosphor is incident on the at least one reflection device. This provides a simple means of implementing a deliberate distortion for achieving a desired light distribution. Moreover, magnification effects can be achieved. The advantage of reflection devices is that the phosphor can be oriented up, down or laterally with respect to the direction of travel of the motor vehicle, thereby allowing a greater degree of freedom for implementing a headlight module according to the invention. In addition, different length/width ratios of the emitting area can be implemented, which means that the design of a headlight having a headlight module according to the invention can be easily adapted to suit end customers' specifications.

DETAILED DESCRIPTION OF THE DRAWINGS

Figure 1:
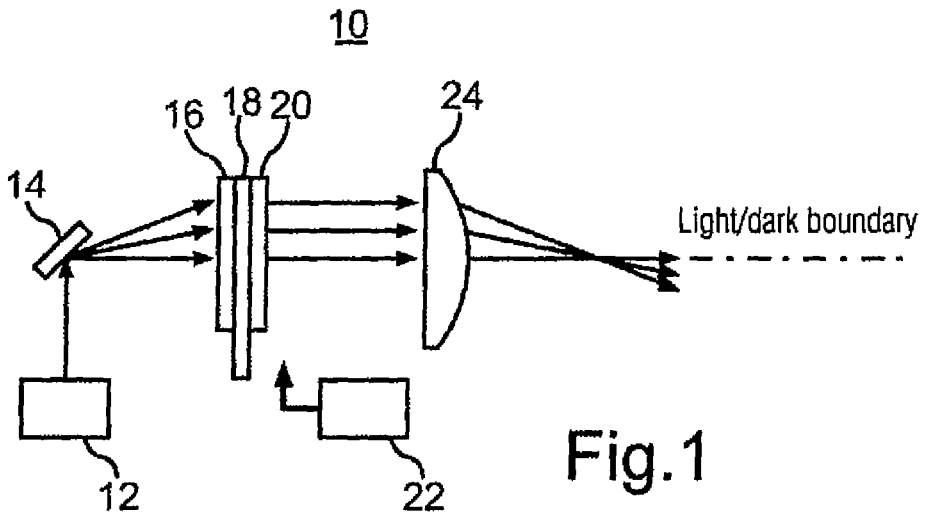
FIG. 1 schematically illustrates a first exemplary embodiment of a headlight module according to the invention.

In the different figures, the same reference characters are used for components that are identical or have an identical effect. These will therefore only be introduced once.

FIG. 1 schematically illustrates a first exemplary embodiment of a headlight module 10 according to the invention. This comprises at least one radiation source 12 which is preferably implemented as a blue light emitting laser, in particular as a blue light emitting laser diode. Radiation from the excitation radiation source 12 is incident on a beam directing device 14 which is preferably implemented as a micromirror device. The radiation emitted by the beam directing device 14 first passes through an optical filter device 16, then a carrier device 18 for the at least one phosphor and finally the at least one phosphor 20. The carrier device 18 preferably consists of highly thermally conductive material. The optical filter device 16 is designed such that it admits radiation from the radiation source 12 while reflecting radiation emitted by the phosphor 20. The beam directing device 14 is designed to deflect radiation emitted by the radiation source 12 such that different regions of the phosphor 20 are successively excited. The carrier device 18 is preferably made of ceramic, e.g. polycrystalline aluminum oxide ceramic (PCA) or sapphire.

The phosphor 20 can be composed of a plurality of different phosphor components which convert the electromagnetic radiation of the radiation source 12 into light of different wavelengths or colors. In addition, the phosphor 20 can also be a phosphor mix. Since in the phosphor 20 approximately 20% of the energy is lost due to the Stokes shift and converted into heat, the phosphor 20 is cooled by means of a cooling device 22. This can be a fan, for example. An optical device 24, e.g. a projection lens with a focal length of 20 to 100 mm, enables the luminance distribution to be mapped distortion-free to the far field.

The embodiment of a headlight module according to the invention as shown in FIG. 1 is characterized in that the radiation from the radiation source 12 is incident on the phosphor 20 at a very small angle, which means that the spot size, i.e. the diameter of the beam incident on the phosphor 20, is kept small and optimum excitation of the phosphor is ensured. Typical spot sizes are 0.1 to 0.2 mm in order to ensure the necessary resolution for producing different light distributions. The phosphor 20 and the radiation source 12 are matched such that the light emitted by the headlight module 10 is white with a color temperature ranging from 3000 to 6500 Kelvin.

Figure 2:
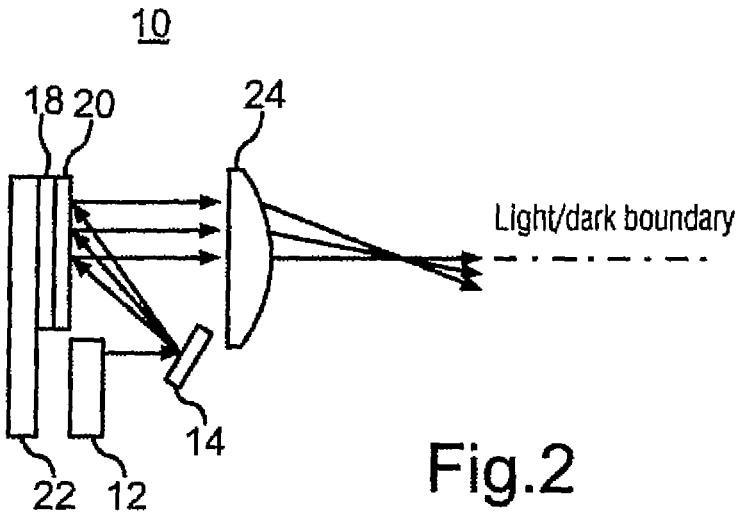
FIG. 2 schematically illustrates a second exemplary embodiment of a headlight module according to the invention.

The embodiment of a headlight module 10 according to the invention illustrated schematically in FIG. 2 is characterized by a much smaller overall depth than the embodiment shown in FIG. 1. Here the combination of radiation source 12 and beam directing device 14 is mounted such that it is incident on a side of the phosphor 20 facing away from the carrier device 18. The carrier device 18 is designed to reflect radiation emitted by the at least one phosphor 20 and/or radiation emitted by the at least one excitation radiation source 12. The carrier device 18 can also itself be implemented as a heat sink. As a result, the embodiment shown in FIG. 2 is characterized by extremely low manufacturing costs. Also indicated is the light/dark boundary HDG. (also in FIG. 1)

Figure 3:
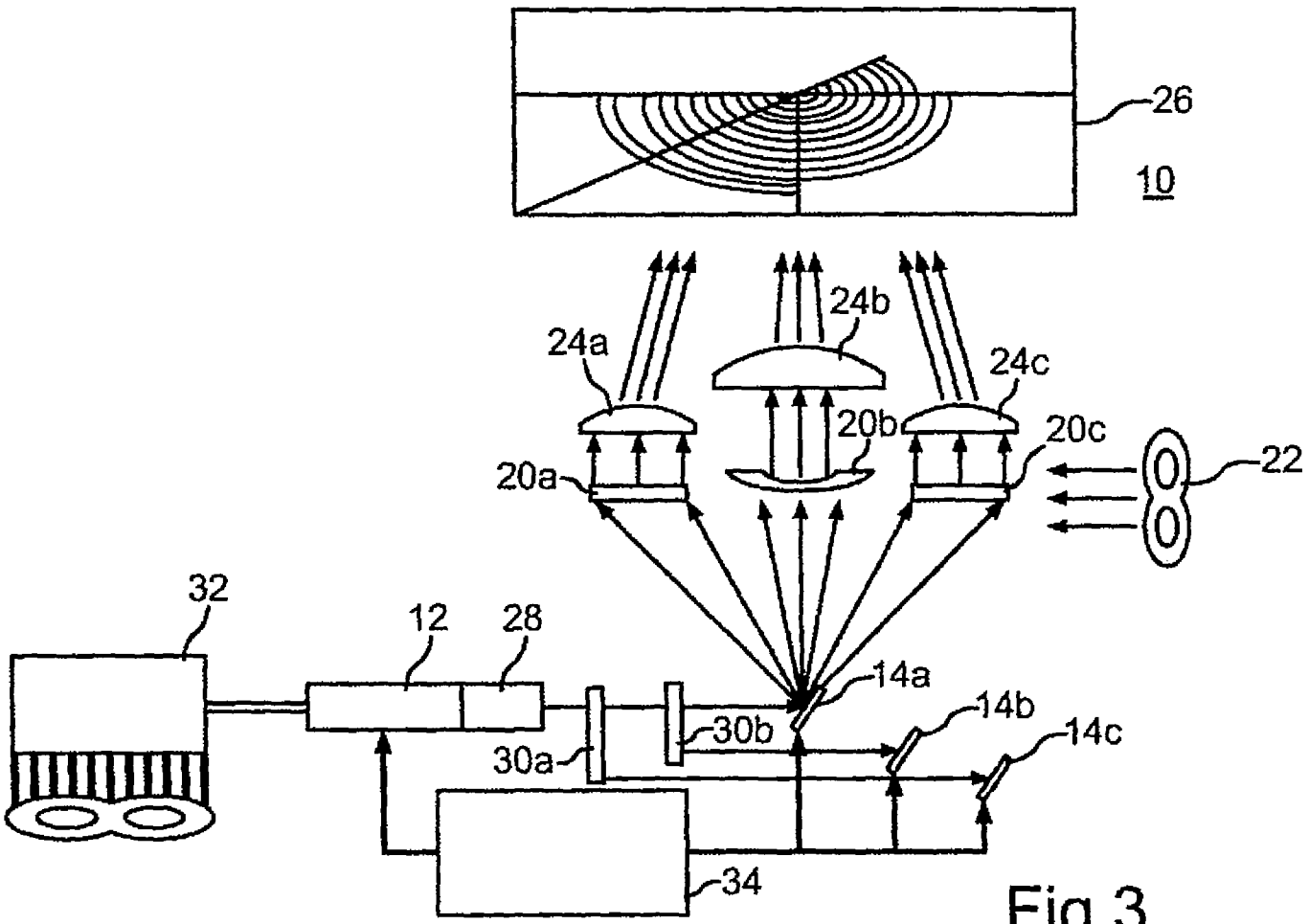
FIG. 3 schematically illustrates a third exemplary embodiment of a headlight module according to the invention.

In the exemplary embodiment of a headlight module 10 according to the invention illustrated in FIG. 3, by way of example three separate phosphors 20*a*, 20*b*, 20*c* are provided, each phosphor being assigned an optical device 24*a*, 24*b*, 24*c* and the light emitted by the optical devices 24*a*, 24*b*, 24*c* being merged into an overall image 26. By way of example it is indicated that an optical device 28, e.g. a lens, can be connected downstream of the radiation source 12. The radiation leaving the lens 28 is fed by means of two beam splitter devices 30*a*, 30*b* to three beam directing devices 14*a*, 14*b* and 14*c*.

For the sake of simplicity, it is shown in FIG. 3 that the phosphors 20*a*, 20*b*, 20*c* are only activated by the beam directing device or more specifically the micromirror 14*a*. However, it is also possible for each phosphor 20*a*, 20*b*, 20*c* to be activated by a respective beam directing device or more specifically a respective micromirror 14*a*, 14*b*, 14*c*.

As may be clearly seen, the surface provided with the phosphor 20*b* is curved, while the phosphors 20*a*, 20*c* are disposed on planar surfaces. A cooling device 32 is used to cool the radiation source 12. Also shown is a control device 34 which is used to control the least one radiation source 12 and the beam directing devices 14*a* to 14*c*. The beam directing devices 14*a* to 14*c* can be implemented in particular as micromirrors pivotable about two axes. The control device 34 enables the beam directing devices 14*a* to 14*c* and the radiation source 12 to be controlled in a fixed grid in order to achieve, for example, a light distribution of the headlight in solid angle ranges of plus/minus 50° horizontally and minus 15°/plus 10° vertically. It also enables the radiation source 12 to be briefly switched off during sweeping of the sectors in which no light is currently required.

Control of this kind can be simply implemented, because the horizontal/vertical deflection unit of such a control device 34, which is used to deflect the micromirror horizontally and vertically in order thereby to guide the light beam originating from the radiation source 12 row by row or column by column over the phosphor 20, always operates at the same frequencies and the resonant frequency of the beam directing device 14 can be set in a simple manner. However, as the typical light distribution always fills only a comparatively small solid angle, such an arrangement provides a "duty cycle". In other words, the radiation source 12 is turned off at many positions of the micromirror or rather of the beam directing device 14 and the phosphor 20 must be placed under high load during the ON-time of the radiation source 12 in order to generate the necessary amount of light.

Improved control therefore matches the angular ranges for the horizontal and vertical deflection of the micromirror or rather of the beam directing device 14 to the currently required light distribution. For example, for low beam only a small number of rows above the light/dark boundary HDG are required for the asymmetry of the bundle of rays. Here a correspondingly smaller angular range for the row by row guidance of the micromirror or rather of the beam directing device is therefore sufficient. As a result, in a scanning cycle the radiation source 12 can remain longer in the low-beam solid angle. In the case of cornering light, fewer columns are required, i.e. the radiation source 12 is available longer for the core light distribution. A correspondingly smaller angular range therefore suffices for column by column guidance of the micromirror or rather of the beam directing device 14.

For the last mentioned embodiment of the control function, the beam directing device 14*a*, 14*b*, 14*c* must be operated at different frequencies for rows and columns and therefore requires dynamic tuning of the resonant circuit. Although this results in increased technical complexity, it enables the radiation source 12 to be used more homogeneously over time.

Figure 4:
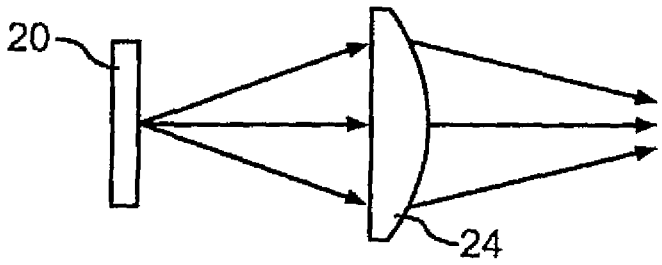
FIG. 4 shows a more detailed illustration of an exemplary embodiment of the present invention having a curved phosphor carrier and an optical device.

FIG. 4 shows in greater detail a combination of phosphor 20 and optical device 24 of a headlight module 10 according to the invention. By way of example, the phosphor surface is of planar design. This can be achieved by appropriate design of the phosphor surface itself or by appropriate design of the carrier device 18. The optical device 24 can be an aspherical lens in order to achieve a magnification and thereby project the intermediate image on the phosphor 20 to infinity. This is the case for automobile headlights from a distance greater than 25 m onwards. The focal plane of such aspherical lenses, i.e. the plane from which a sharp image is focused, is not planar, but typically a curved surface. It is therefore preferable to implement the surface of the phosphor 20, or rather the carrier device 18 for the phosphor 20, as a sphere or more generally as a conical section.

The optical device 24 can also be a freeform lens in order to produce a deliberate distortion. This enables, for example, the light distribution to be extended into peripheral regions, so that the actual phosphor matrix, i.e. the rows and columns to be set by the control device 34 on the phosphor 20, can be kept small, while nevertheless enabling the light distribution to be extended over larger areas.

Figure 5:
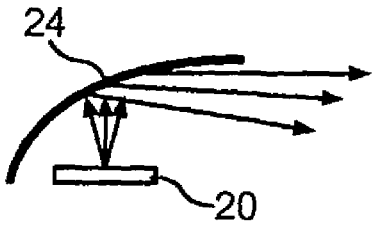
FIG. 5 shows a more detailed illustration of an exemplary embodiment of the present invention having a planar phosphor carrier and a reflection device.

FIG. 5 schematically illustrates an exemplary embodiment wherein the optical device 24 is implemented as a reflection device. The reflection device can be parabolic and then fulfils a similar purpose to an aspherical lens, i.e. rays from a point source are focused to infinity, i.e. made parallel. As the phosphor 20 only radiates in a half-space, no more than a quarter reflector dish is required.

Freeform reflectors can in turn deliberately distort the light distribution, i.e. different magnification and distortion factors can be employed in the different regions of the reflection device.

Reflection devices also have the advantage that the phosphor 20 can be applied above, below or laterally in the direction of travel, thereby providing a greater degree of freedom for designing a system equipped with a headlight module 10 according to the invention. At the same time, different length/width ratios of the exit area can be implemented, thereby providing a wide freedom of choice for the design of a headlight equipped with a headlight module 10 according to the invention.

Figure 6:
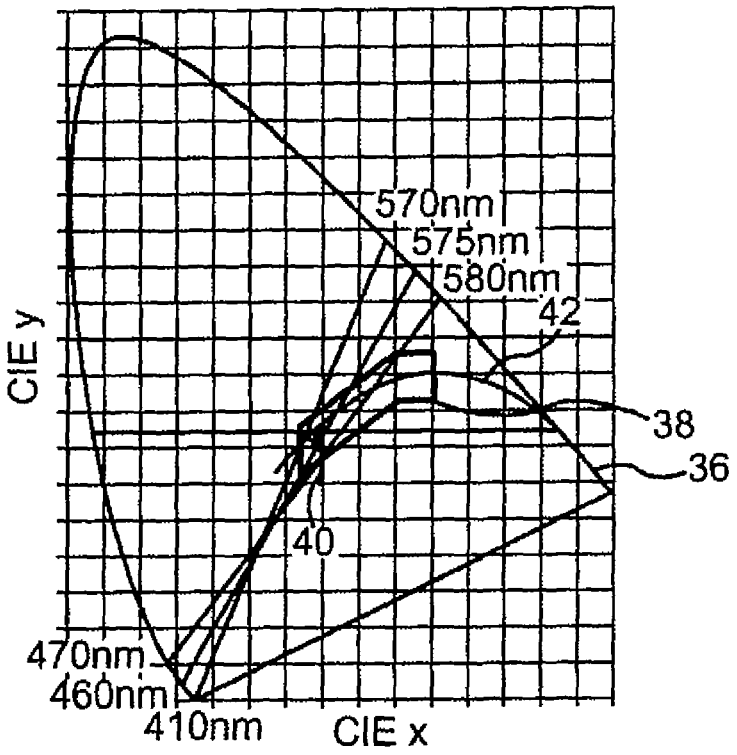
FIG. 6 shows a CIE standard color table for determining the excitation radiation sources and phosphors to be used in a headlight module according to the invention.

FIG. 6 shows a CIE standard color table setting out typical combinations of excitation radiation sources 12 and phosphors 20 such as can be used for a headlight module according to the invention. The curve 36 represents the spectral color. The curve 38 encloses a field deemed to be white according to ECE regulations. Also plotted is the white point 40. The curve 42 represents the Planck curve. Using a headlight module 10 according to the invention in a vehicle headlight requires while light, "white" being defined by the ECE regulations and the CIE standard. The chromaticity coordinate is preferably placed close to the white point 40 (approx. 5500 K or even up to 6500 K) in order to produce day-like color appearance. Depending on the pump wavelength of the laser used as the radiation source 12, which can be between 400 and 480 nm, the phosphor 20 must therefore be centered between 570 and 590 nm. 590 nm tends to produce warm white light and 570 nm with a pump wavelength around 410 nm cold white light. A number of combinations are plotted by way of example in FIG. 6. The connecting line goes through the white field 38 and the chromaticity coordinate can be set there.

The most efficient solution is a phosphor with 570 nm, as this is at the maximum of V (λ) and can be achieved with a laser pump wavelength of 405 nm.

The phosphors 20 employed are of the type already used today for light-emitting diodes for producing white light. For example, the phosphor 20 is cerium-doped yttrium aluminum garnet (YAG:Ce) or related garnets with dopings in different concentrations. Various embodiments of such phosphors 20 may be found in EP 1 471 775. Other typical phosphors are calcines, SCAP-type phosphors, nitridosilicates and chlorosilicates, oxinitrides and silicates, particularly orthosilicates, such as are already known per se and are used for mixing to produce white light. Typical examples thereof are disclosed in the publications DE 10 2006 036577, DE 201 15 914 U1, US 2003/146690, WO 2001/040403, WO 2004/030109, DE 10 2007 060 199, DE 103 19 091 and DE 10 2005 017 510. By means of these phosphors, the light colors warm white, cold white and daylight-like white can be set and in particular white light with a desired color temperature ranging from 3000 to 6500 Kelvin can also be produced using these phosphors. Examples thereof may be found in DE 10 2004 038 199, WO 00/33389 and EP 1 878 063.

By using red-emitting phosphors in the phosphor mix 20, such as nitrides, for example, it is also ensured that the white light contains the red component of more than 5% legally required for vehicle headlights. A laser or more specifically a laser diode which emits ultraviolet radiation or blue light is used as the radiation source 12 for exciting said phosphor mix 20.

In principle, therefore, instead of the blue light emitting laser, a UV radiation source can also be used as the radiation source 12 in a headlight module 10 according to the invention. In this case, at least two different phosphors whose chromaticity coordinates are diametrically opposite with respect to the white point 40 are required for producing the white light. This results in increased color quality, as the spectrum of the light can be controlled independently of the pump wavelength of the excitation radiation source 12.

With a headlight module 10 according to the invention, the light emitted by the headlight module 10 is preferably composed of two color components, in particular the radiation of the radiation source 12 and the radiation emitted by one or more phosphors. This enables the wavelength of the emitted light to be very well controlled, which means that color control is much simpler than with today's white LEDs.

With a 3-color system, e.g. red, green and blue (RGB), the color quality, i.e. the color rendering index, can be greatly enhanced and the entire color space spanned by the phosphors can be represented by variably modulating the different colors.

For the approval of motor vehicle headlights, legal regulations require the possibility of range setting. In the prior art, the light/dark boundary HDG of the headlight is selectively inclined by 1% corresponding to 0.57° below the horizon, which means that electric servomotors, in some cases even very complex stepper motors, are required in the headlight according to the prior art. In the headlight module 10 according to the invention, these servomotors can be dispensed with, as the light/dark boundary can be precisely controlled within the range of 0.1°. This can be achieved by a correspondingly fine adjustment of the row signal for the beam directing device. However, as the latter is an analog signal, basically no limits are set in respect of the resolution of the light/dark boundary for a headlight module 10 according to the invention. Via appropriate action of the control device 34, e.g. through connection to the motor vehicle's bus system which is linked to inclination sensors in the vehicle, or rather by manual input to the driver's control panel, an effect equivalent to tilting can be achieved by appropriate control of the beam directing device 14 in a headlight module 10 according to the invention.

The control device 34 is designed, moreover, to adjust the range setting to a predefined value if communication with the motor vehicle fails. At the same time, the control applied to the beam directing device 14 is preferably changed over to normal low beam by a permanently stored light distribution in order to protect the phosphor 20.

If the radiation source 12 fails or is operating incorrectly or with low power, it is also provided to indicate to the driver that a defect is present, typically by means of a corresponding warning light on the dashboard, thereby making the driver aware of the limited functionality and that a visit to the garage is necessary.

If the beam directing device 14 fails, a warning signal is likewise given to the driver and the radiation source 12 is disconnected. Finally it is provided to deactivate the radiation source 12 if the vehicle is in a garage for maintenance and the headlight module 10 has to be opened, thereby reliably protecting the maintenance personnel. Likewise a safety device can also be provided which switches off the radiation source 12 if the headlight housing is open or in the event of an accident, particularly if the headlight housing is cracked.

The output of the excitation radiation source 12 is preferably between 5 and 20 W.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A headlight module comprising:

separate phosphors adapted to be excited by electromagnetic radiation to emit light; and at least one radiation source for exciting the phosphors;

each phosphor having an associated optical device, said optical devices being configured so that light emitted by said optical devices is merged into an overall image;

beam splitter devices and beam directing devices disposed such that electromagnetic radiation emitted by said at least one radiation source is directed on the phosphors; and a control device for controlling operation of the at least one radiation source and the beam directing devices.

2. The headlight module as claimed in claim 1, wherein the beam directing devices are micromirrors which are pivotable about two axis.

3. The headlight module as claimed in claim 2, wherein the control device comprises a horizontal/vertical deflection unit for horizontal and vertical deflection of the micromirrors.

4. The headlight module as claimed in claim 3, wherein the control device is configured to match an angular range of the horizontal and vertical deflection of the micromirrors to a required light distribution.

5. The headlight module as claimed in claim 3, wherein the control device and the micromirrors are configured to operate at different frequencies for horizontal and vertical deflection of the micromirrors.

6. The headlight module as claimed in claim 1, wherein the control device is configured to control operation of the beam directing devices and the at least one radiation source in a fixed grid so that a light distribution of the headlight in angle ranges of plus 50° to minus 50° horizontally, minus 15° to plus 10° vertically is achieved.

7. The headlight module as claimed in claim 6, wherein the control device is configured to briefly switch off the at least one radiation source during sweeping of sectors of said angle ranges in which no light is currently required.

8. The headlight module as claimed in claim 1, wherein at least one of the phosphors is arranged on a curved surface.

9. The headlight module as claimed in claim 1, wherein each of the phosphors is activated by a respective beam directing device.

* * * * *